US007628474B2

(12) United States Patent
Mita et al.

(10) Patent No.: US 7,628,474 B2
(45) Date of Patent: Dec. 8, 2009

(54) LIQUID DISCHARGING HEAD WITH RECESS IN VIBRATION PLATE

(75) Inventors: Tsuyoshi Mita, Kanagawa (JP); Hisamitsu Hori, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 122 days.

(21) Appl. No.: 10/951,822

(22) Filed: Sep. 29, 2004

(65) Prior Publication Data

US 2005/0259135 A1 Nov. 24, 2005

(30) Foreign Application Priority Data

Sep. 30, 2003 (JP) ..... 2003-342292

(51) Int. Cl.
*B41J 2/045* (2006.01)

(52) U.S. Cl. ..... 347/70

(58) Field of Classification Search ..... 347/70, 347/72

See application file for complete search history.

(56) References Cited

U.S. PATENT DOCUMENTS

| | | | | |
|---|---|---|---|---|
| 4,364,070 | A | 12/1982 | Matsuda et al. | 347/70 |
| 5,424,769 | A * | 6/1995 | Sakai et al. | 347/70 |
| 5,637,801 | A * | 6/1997 | Ichihashi | 73/715 |
| 6,382,781 | B2 * | 5/2002 | Furuhata et al. | 347/70 |
| 6,584,660 | B1 * | 7/2003 | Shimogawa et al. | 29/25.35 |
| 6,685,306 | B2 * | 2/2004 | Sugahara | 347/72 |
| 6,719,409 | B2 | 4/2004 | Sasaki et al. | |
| 2002/0018095 | A1 | 2/2002 | Nakamura et al. | |
| 2002/0075362 | A1 | 6/2002 | Nakamura et al. | |
| 2007/0007859 | A1 * | 1/2007 | Weber | 310/324 |

FOREIGN PATENT DOCUMENTS

| | | | |
|---|---|---|---|
| EP | 0 919 383 | A2 | 6/1999 |
| EP | 1 321 295 | A2 | 6/2003 |
| EP | 1321295 | A2 | 6/2003 |
| JP | 55-109668 | A | 8/1980 |
| JP | 58098259 | A * | 6/1983 |
| JP | 63-57250 | A | 3/1988 |
| JP | 1-204748 | A | 8/1989 |
| JP | 11-300971 | A | 11/1999 |
| JP | 11-309864 | A | 11/1999 |
| JP | 2000-71449 | A | 3/2000 |
| JP | 2000-94688 | A | 4/2000 |
| JP | 2001-334661 | A | 12/2001 |
| JP | 2002-225264 | A | 8/2002 |
| JP | 2002-248765 | A | 9/2002 |

OTHER PUBLICATIONS

English Translation of JP 58-098259 entitled "Inkjet Head", translated May 2007 by McElroy Translation Company.*

* cited by examiner

*Primary Examiner*—Matthew Luu
*Assistant Examiner*—Shelby Fidler
(74) *Attorney, Agent, or Firm*—Birch, Stewart, Kolasch & Birch, LLP

(57) ABSTRACT

The discharging head for discharging liquid onto a discharge receiving medium includes a vibration plate forming at least a portion of a pressure chamber storing liquid to be discharged and a piezoelectric element, joined to the vibration plate, for generating a pressure forming a discharge force for discharging liquid inside the pressure chamber. A recess is formed in the approximate center of the region of the vibration plate where the piezoelectric element is installed.

17 Claims, 18 Drawing Sheets

LIQUID DISCHARGING HEAD WITH RECESS IN VIBRATION PLATE

This Nonprovisional application claims priority under 35 U.S.C. 119(a) on Patent Application No(s). 2003-342292 filed in Japan on Sep. 30, 2003, the entire contents of which are hereby incorporated by reference.

BACKGROUND OF THE INVENTION

1. Field of the Invention

The present invention relates to a discharging head and a liquid discharging apparatus, and particularly, to a liquid discharging head for discharging liquid droplets by means of energy generated by an actuator.

2. Description of the Related Art

Recently, inkjet recording apparatuses (inkjet printers) have become common as recording apparatuses for printing and recording images captured by digital still cameras, and the like. An inkjet recording apparatus comprises a plurality of nozzles (recording elements) in a head, the recording head being scanned while droplets of ink are discharged onto a recording medium from the nozzles, the recording medium being conveyed through a distance corresponding to one line, each time one line of an image is recorded onto recording paper, and an image being formed onto the recording paper by repeating this process.

Inkjet printers include those which use a fixed-length serial head, and carry out recording by scanning the head in the lateral direction of a recording medium, and those which use a line head in which recording elements are arrayed over a length corresponding to the full dimension of one edge of the recording medium. In a printer using a line head, it is possible to record an image across the entire surface of the recording medium, by scanning the recording medium in an orthogonal direction to the direction in which the recording elements are arranged. In a printer using a line head, it is not necessary to provide a conveyance system, such as a carriage, for scanning a short-dimension head, nor is it necessary to move a carriage, or perform complicated scanning control of the recording medium. Furthermore, since only the recording medium is moved, it is possible to increase the recording speed in comparison to printers using serial heads.

Ink chambers (or pressure chambers) for storing ink to be discharged are provided respectively at the plurality of nozzles discharging ink, and these ink chambers are connected respectively to the nozzles. When pressure is applied to the ink inside an ink chamber, ink is discharged from the corresponding nozzle.

Pressure may be applied to the ink by means of a thermal jet method, wherein the ink is heated by providing a heat source in each ink chamber, a bubble is created due to this heat, and this bubble pressurizes the ink inside the ink chamber, or by means of piezoelectric method, wherein a piezoelectric element is provided on the wall of each ink chamber, the wall of the ink chamber is pressurized by displacement of this piezoelectric element, and the ink inside the ink chamber is discharged due to this pressure.

In the piezoelectric method described above, various ways have been devised for efficiently transmitting the energy of the piezoelectric element to the ink inside the ink chamber.

Japanese Patent Application Publication No. 63-57250 discloses an inkjet head having a structure where grooves for concentrating the distortion energy are provided on a vibration plate which vibrates due to the distorting effect of drive elements. These grooves are formed on the surface of the vibration plate where the drive elements are installed, or on the surface which opposes the ink chambers. Thereby, the ink droplet ejection efficiency is improved, without having to increase the drive voltage applied to the drive elements or reduce the thickness of the vibration plate. Furthermore, vibrations generated in the ink chambers during driving are prevented from affecting adjacent ink chambers, which are not being driven.

Japanese Patent Application Publication No. 11-300971 discloses an inkjet recording head and an inkjet recording apparatus, wherein a vibration plate forms a portion of a pressure generating chamber connected to a nozzle opening, and this vibration plate contains a recess situated in a portion of the inner side of the pressure generating chamber. Thereby, initial variations in the vibration plate are suppressed.

Japanese Patent Application Publication No. 11-309864 discloses an inkjet recording head and an inkjet recording apparatus, wherein a vibration plate forms a portion of a pressure generating chamber connected to a nozzle opening. This vibration plate contains recesses extending longitudinally along the inner sides of the pressure generating chamber, and these recesses are situated on at least either side in the lateral direction of the chamber. Thereby, the displacement generated by driving the piezoelectric actuator unit is increased.

Furthermore, Japanese Patent Application Publication No. 2002-225264 discloses an inkjet printer head and a piezoelectric/electrostrictive actuator for an inkjet printer head, wherein a recess is formed in a vibration transmitting plate forming a wall of a pressure chamber, the recess being of reduced rigidity. Thereby, a structure is achieved wherein the perimeter region of the vibration transmitting plate also contributes to producing displacement.

However, if the voltage applied to the piezoelectric elements is set to a high voltage in order to increase the displacement of the piezoelectric elements, then the size of the power source supplying voltage to the piezoelectric elements must be increased, and furthermore, protective circuits, and the like, must be provided, in order to handle the high voltage. Moreover, the vibration plate which is pressurized by the piezoelectric elements loses strength if it is reduced in thickness. Therefore, cross-talk between adjacent ink chambers is more liable to occur. In addition, the manufacturing processes required to produce a vibration plate of reduced thickness are complicated, and such a plate is difficult to manufacture.

In the inkjet head according to Japanese Patent Application Publication No. 63-57250, there is no disclosure regarding the positioning of the grooves provided in the vibration plate, or the shape of these grooves.

Furthermore, in the inkjet recording head and inkjet recording apparatus according to Japanese Patent Application Publications Nos. 11-300971 and 11-309864, recesses provided in the longitudinal direction are disclosed, but the beneficial effect of such recesses is limited to pressure generating chambers having a rectangular or diamond shape.

Furthermore, in the inkjet printer head and piezoelectric/electrostrictive actuator for an inkjet printer head according to Japanese Patent Application Publication No. 2002-255264, some beneficial effect is obtained in terms of increasing displacement, but beneficial effects in reducing cross-talk and stabilizing bonding are not readily achieved.

SUMMARY OF THE INVENTION

The present invention is devised with the foregoing in view, an object thereof being to provide an inkjet head and droplet discharging apparatus, whereby the displacement of the vibration plate can be increased, the effects of cross-talk on adjacent liquid chambers can be restricted, and the bonding stability of the piezoelectric elements can be ensured.

In order to achieve the aforementioned object, the invention is a discharging head for discharging liquid onto a discharge receiving medium, comprising: a vibration plate forming at least a portion of a pressure chamber storing liquid to be discharged; and a piezoelectric element, joined to the vibration plate, for generating a pressure forming a discharge force for discharging liquid inside the pressure chamber; wherein a recess is formed in the approximate center of the region of the vibration plate where the piezoelectric element is installed.

More specifically, since a recess is formed in the vibration pate forming at least a portion of the pressure chamber, in the region of the vibration plate bonded with the piezoelectric element, then the rigidity of the vibration plate is reduced in this section and the displacement of the vibration plate when it receives pressure from the piezoelectric element can be increased.

Here, the recess also includes recesses formed by a combination of two or more recess sections (grooves). The two or more recess sections may be formed to the same shape or to different shapes.

The discharging head may be a full line type discharging head wherein discharge ports are arranged throughout the entire printable region in the width direction of a discharge receiving medium, or it may be a serial type (shuttle scan type) discharging head which performs discharge by moving a discharging head of short dimensions in the width direction of the discharge receiving medium. Furthermore, it may also be a divided type head which comprises a plurality of discharging heads in the width direction of the discharge receiving medium.

Moreover, "discharge receiving medium" indicates a medium receiving a liquid discharged by means of a discharging head, and this term includes various types of media, irrespective of material and size, such as continuous paper, cut paper, sealed paper, resin sheets, such as OHP sheets, film, cloth, and other materials.

Preferably the shape of the recess in plan view is a shape having rotational symmetry that is identical when rotated by n degrees (where $n<180°$).

In other words, the vibration plate can be displaced more efficiently, if the recess is of a shape having rotational symmetry.

The shape in plan view means the shape when viewing the vibration plate from the side of the surface bonded with the piezoelectric element.

A shape having rotational symmetry may be, for example, a cross shape consisting of two recess sections which are mutually orthogonal in the approximate center thereof, or a shape which is substantially circular, or substantially square, in plan view.

The cross-sectional shape of the recess may be substantially square or it may be substantially rectangular. Furthermore, it may also be semicircular, oval, or another shape.

If the recess is formed by wet etching, or the like, then the width to depth ratio of the recess will approximately 1. However, if anisotropic silicon etching, or the like, is used to form the recess, then a depth to width ratio exceeding 1 can be achieved.

Preferably, the recess is provided on the surface of the vibration plate where the piezoelectric element is bonded.

By providing the recess on the surface of the vibration plate that is bonded with the piezoelectric element, then in addition to increasing the displacement of the vibration plate, the recess can also serve as an escape groove for adhesive or air bubbles during bonding of the piezoelectric element to vibration plate.

Therefore, accumulation of adhesive can be prevented and stable bonding of the piezoelectric element can be achieved. Furthermore, air bubbles are not liable to become trapped during bonding.

Preferably, a recess is provided on the surface of the vibration plate where the piezoelectric element is bonded, in the position of the outer perimeter of the piezoelectric element.

In other words, by providing a recess outside the region where the piezoelectric element is bonded, it is possible to reduce cross-talk caused by the effects of the operation of adjacent piezoelectric elements.

Moreover, in order to achieve the aforementioned object, the invention is a discharging head for discharging liquid onto a discharge receiving medium, comprising: a vibration plate forming at least a portion of a pressure chamber storing liquid to be discharged; and a piezoelectric element, joined to the vibration plate, for generating a pressure forming a discharge force for discharging liquid inside the pressure chamber; wherein a first recess is provided on the surface of the vibration plate where the piezoelectric element is bonded, and a second recess is provided on the surface of the vibration plate adjacent to the pressure chamber.

Desirably, the first recess and the second recess are provided at displaced positions in plan view. Moreover, the first recess and the second recess may be of the same shape or they may be of different shapes. Furthermore, there may be only one first recess and only one second recess, or there may be a plurality of such recesses.

Moreover, preferably, the first recess is provided in the approximate center of the region of the vibration plate where the piezoelectric element is installed.

In other words, since the first recess is provided in the approximate center of the region where the piezoelectric element is installed, then it contributes to increasing the displacement of the vibration plate, and ensuring the stability of the bond between the piezoelectric element and the vibration plate.

Desirably, the first recess provided in the region where the piezoelectric element is installed is of a shape having rotational symmetry.

Furthermore, preferably, the second recess is provided in a position corresponding to a region outside the region where the piezoelectric element is installed.

In other words, since the second recess is provided in a position outside the region of the piezoelectric element, it contributes to reducing cross-talk.

Furthermore, preferably, a third recess is provided on the surface of the vibration plate where the piezoelectric element is bonded, in a region outside the region where the piezoelectric element is installed.

In other words, if a third recess is provided on the surface of the vibration plate bonded with the piezoelectric element, outside the region of the piezoelectric element, then cross-talk can be reduced further.

Desirably, the second recess and the third recess are provided in different positions in plan view.

Furthermore, preferably, a fourth recess is provided on the surface of the vibration plate where the piezoelectric element is bonded, in the region where the piezoelectric element is installed.

In other words, if a fourth recess is provided on the surface of the vibration plate bonded with the piezoelectric element, in the region where the piezoelectric element is installed, then the bonding stability of the piezoelectric element can be improved further.

The first recess may be connected with the third recess and fourth recess.

Furthermore, preferably, the shape of the pressure chamber in plan view is a shape whereby a ratio between the length in the longitudinal direction and the length in the lateral direction is approximately 1.

Shapes whereby a ratio between the length in the longitudinal direction and the length in the lateral direction, in other words, an aspect ratio, is substantially equal to 1 include regular or approximate polygonal shapes, such as regular or approximate squares or hexagons, or approximate circular shapes.

Furthermore, preferably, the piezoelectric element is a piezoelectric element operating in d31 mode.

Furthermore, preferably, pressure chambers having the aforementioned vibration plates are arranged two-dimensionally.

A split electrode type piezoelectric element may also be employed instead of the separate mechanisms shown in the diagram. In this type of piezoelectric element, a plurality of individual electrodes are provided on a single piezoelectric plate, and the respective sections where the electrodes are installed (the active piezoelectric sections) are operated independently. In this case, the regions where the piezoelectric elements are installed form the active regions.

According to the present invention, a recess is formed in a vibration plate forming at least a portion of a pressure chamber, and the recess is situated in the approximate center of the region where a piezoelectric element is installed on the vibration plate. Therefore, rigidity is reduced at the position of the recess, and the vibration plate becomes more liable to distort, thereby increasing the amount of displacement of the vibration plate. Furthermore, by providing a recess on the surface where the piezoelectric element is bonded, it is possible to ensure stable bonding of the piezoelectric element.

On the other hand, by providing a recess outside the region where the piezoelectric element is installed, it is possible to reduce cross-talk.

DETAILED DESCRIPTION OF THE PREFERRED EMBODIMENTS

General Configuration of an Inkjet Recording Apparatus

Figure 1:
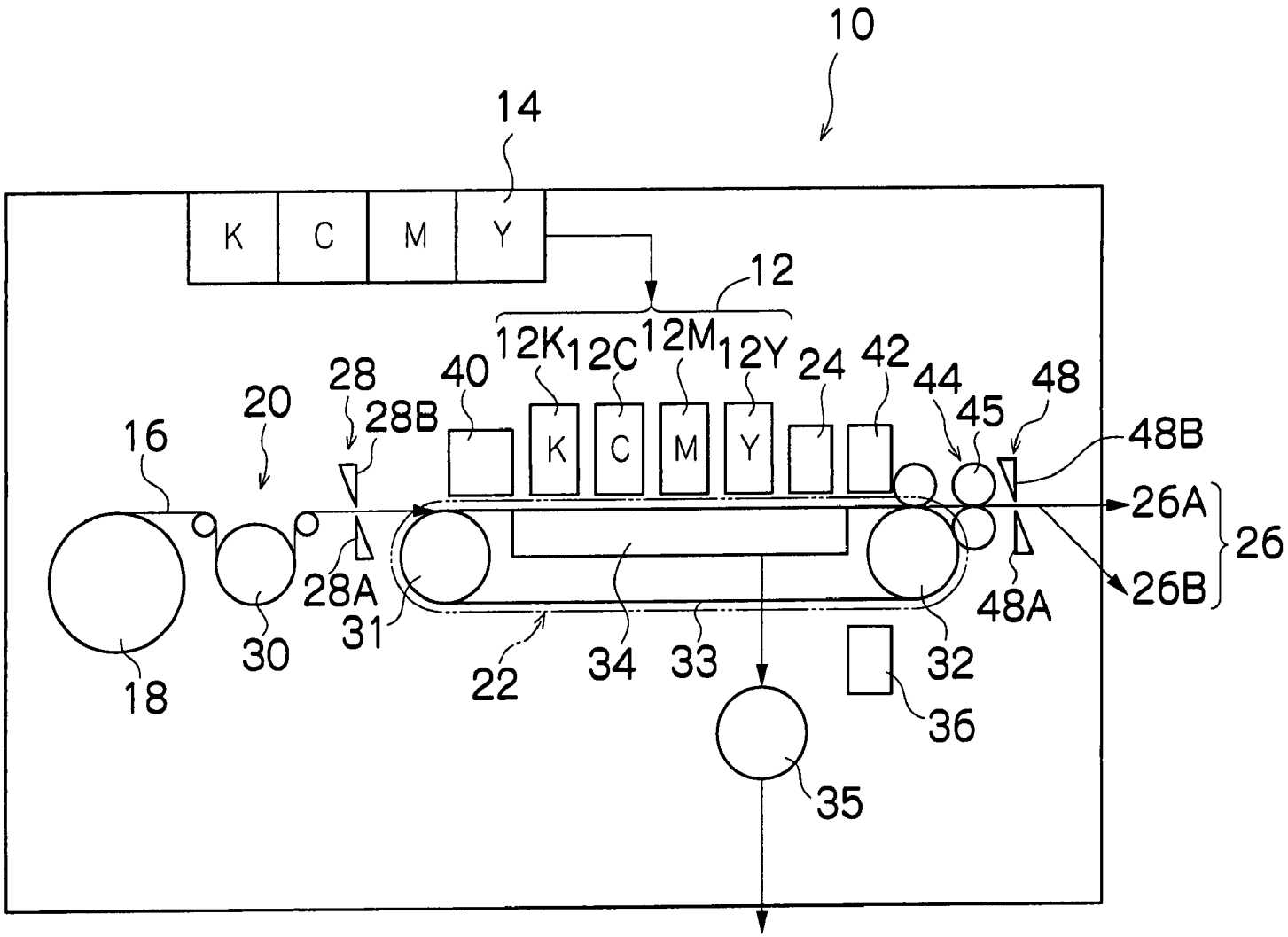
FIG. 1 is a basic compositional diagram of an inkjet recording apparatus relating to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1. The belt 33 is described in detail later.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
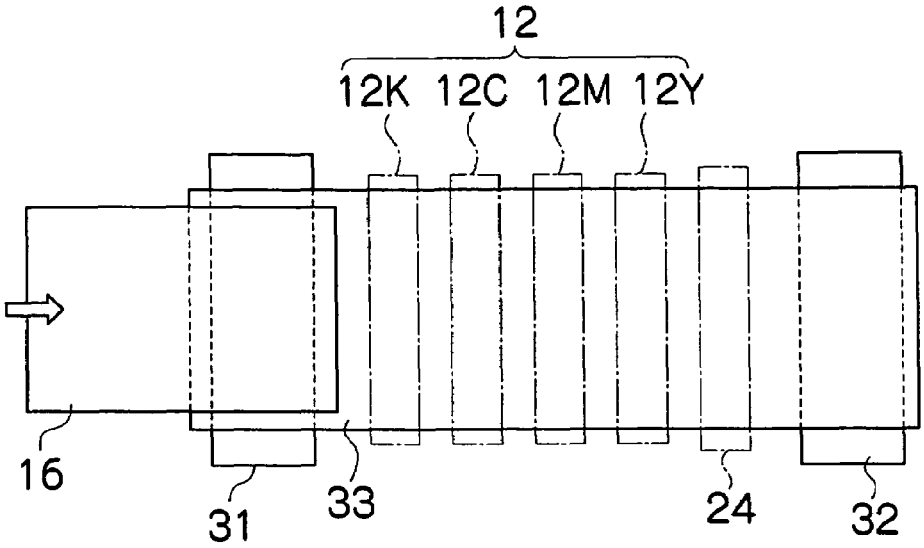
FIG. 2 is a plan view of the principal part of the peripheral area of a print unit of the inkjet recording apparatus illustrated in FIG. 1.

As shown in FIG. 2, the printing unit 12 forms a so-called full-line head in which a line head having a length that corresponds to the maximum paper width is disposed in the main scanning direction perpendicular to a paper conveyance direction (a conveyance direction of the recording paper 16) represented by the arrow in FIG. 2, which is substantially perpendicular to a width direction of the recording paper 16. A specific structural example is described later. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction of the recording paper 16 (hereinafter referred to as the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern (or a real image) printed with the print heads 12K, 12C, 12M, and 12Y for the respective colors, and the ejection of each head is determined. The ejection determination includes the presence of the ejection, measurement of the dot size, and measurement of the dot deposition position. Also, the print determination unit 24 is provided with a light source (not shown) for directing light to dots formed by deposited droplets.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. Preferably, the target print intended to be printed (in which the desired image is printed) and the test print are output separately. In the inkjet recording apparatus 10, a selection device (not shown) is provided and the selection device switches an output route so that the target print and the test print are sorted and fed to an output unit 26A, 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints. Reference numeral 26B indicates a test print output unit.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
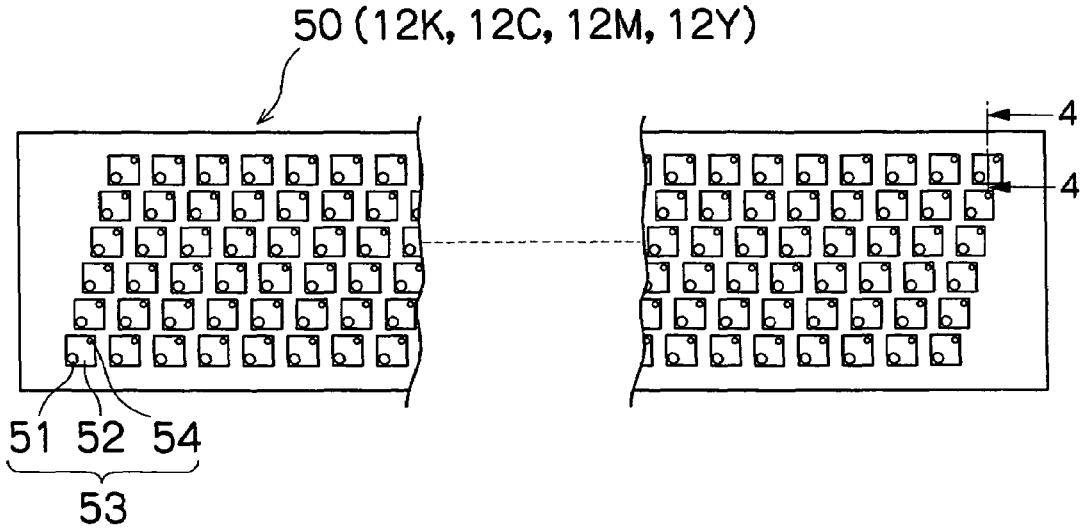
FIG. 3A is a plan view perspective diagram showing an example of the composition of a print head.
Figure 3B:
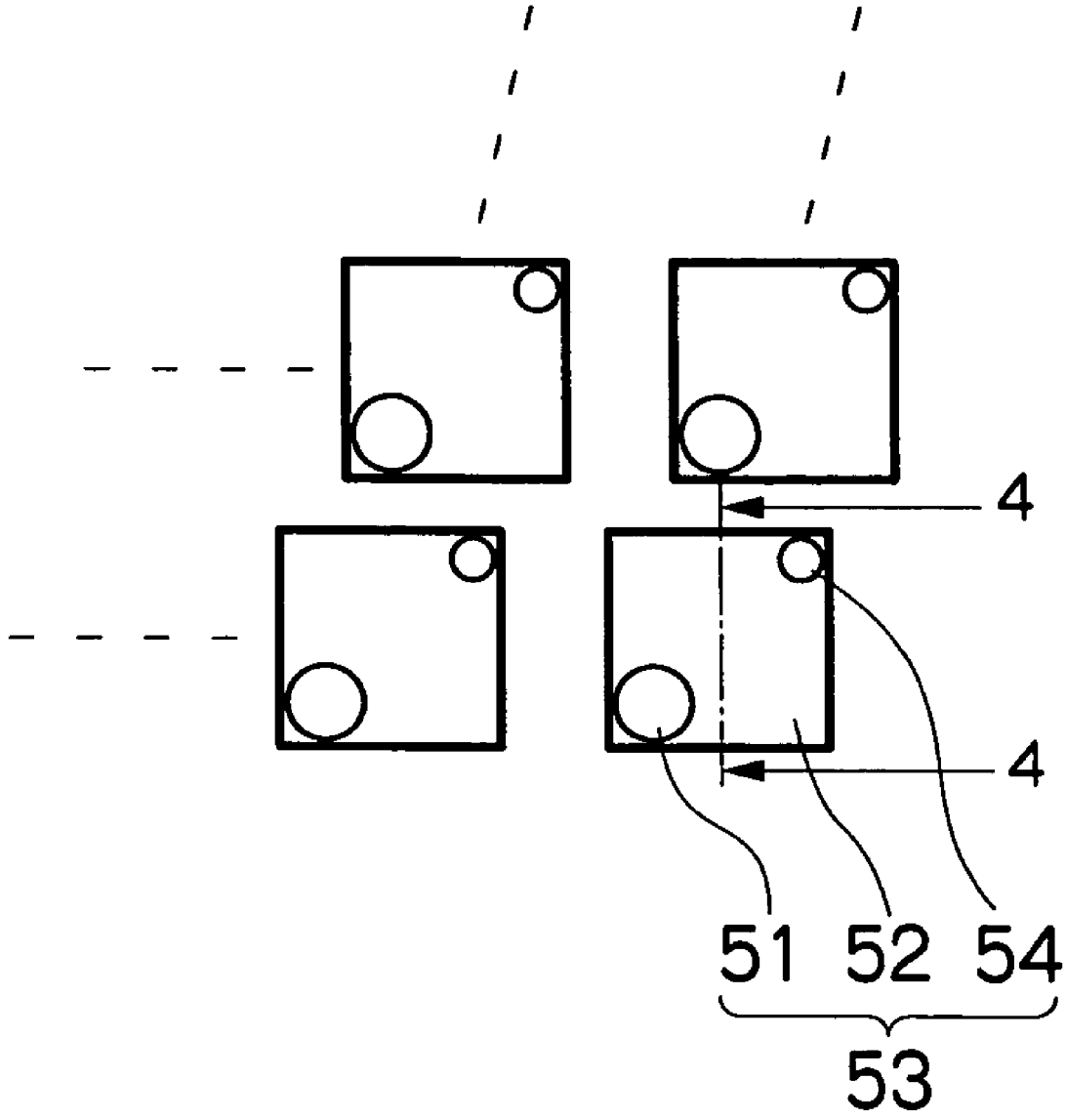
FIG. 3B is a principal enlarged view of FIG. 3A.
Figure 3C:
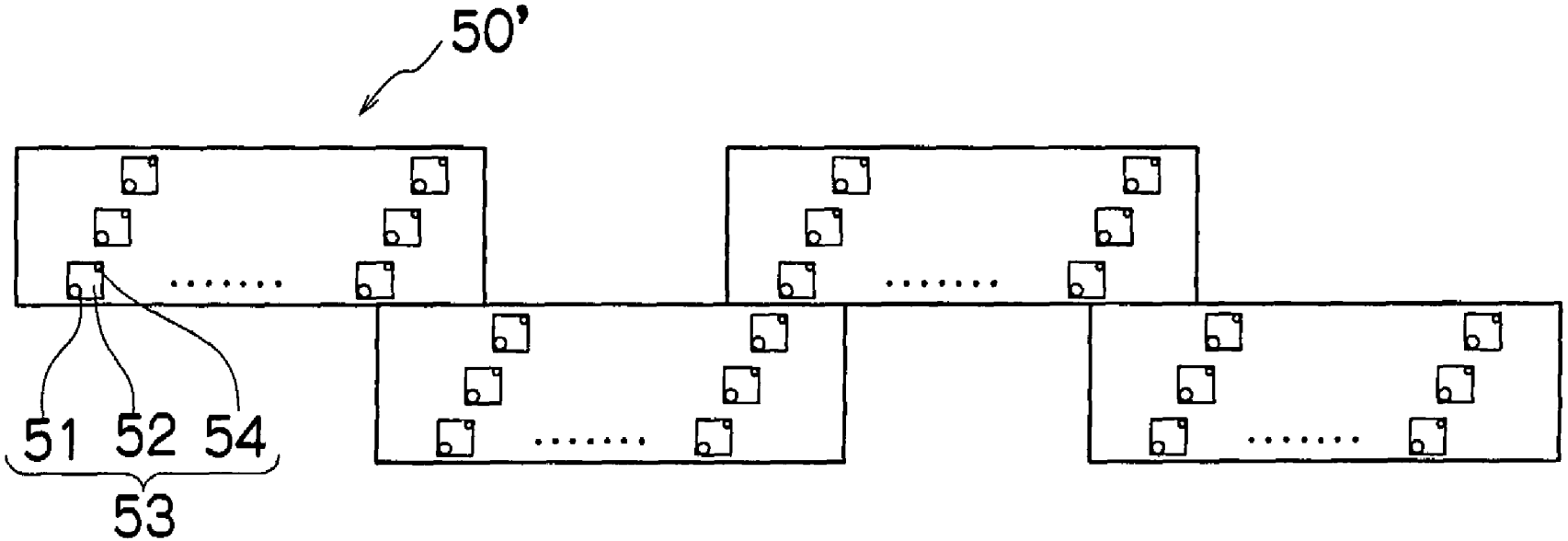
FIG. 3C is a plan view perspective diagram showing a further example of the composition of a print head.
Figure 4:
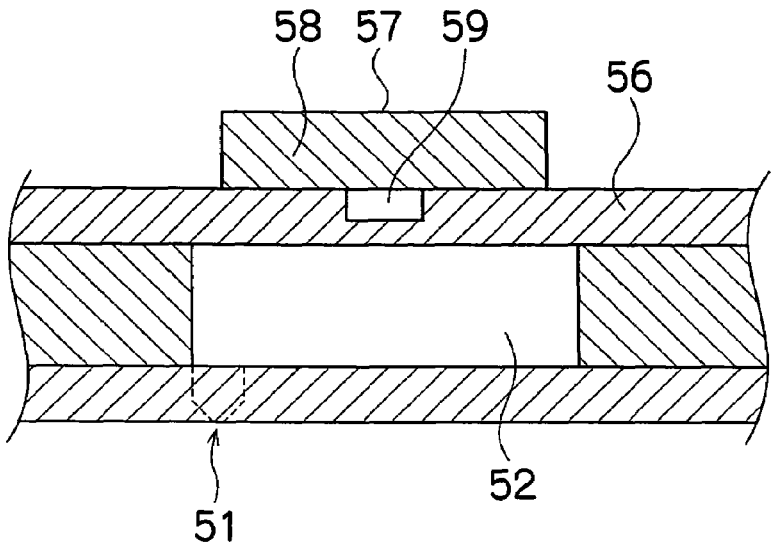
FIG. 4 is a cross-sectional view along line 4-4 in FIG. 3A.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 44 in FIGS. 3A and 3B, showing the inner structure of an ink chamber unit. The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

The planar shape of the pressure chamber 52 provided for each nozzle 51 is substantially a square, and the nozzle 51 and an inlet of supplied ink (supply port) 54 are disposed in both corners on a diagonal line of the square. Each pressure chamber 52 is connected to a common channel (not shown) through the supply port 54.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel through the supply port 54 to the pressure chamber 52.

Figure 5:
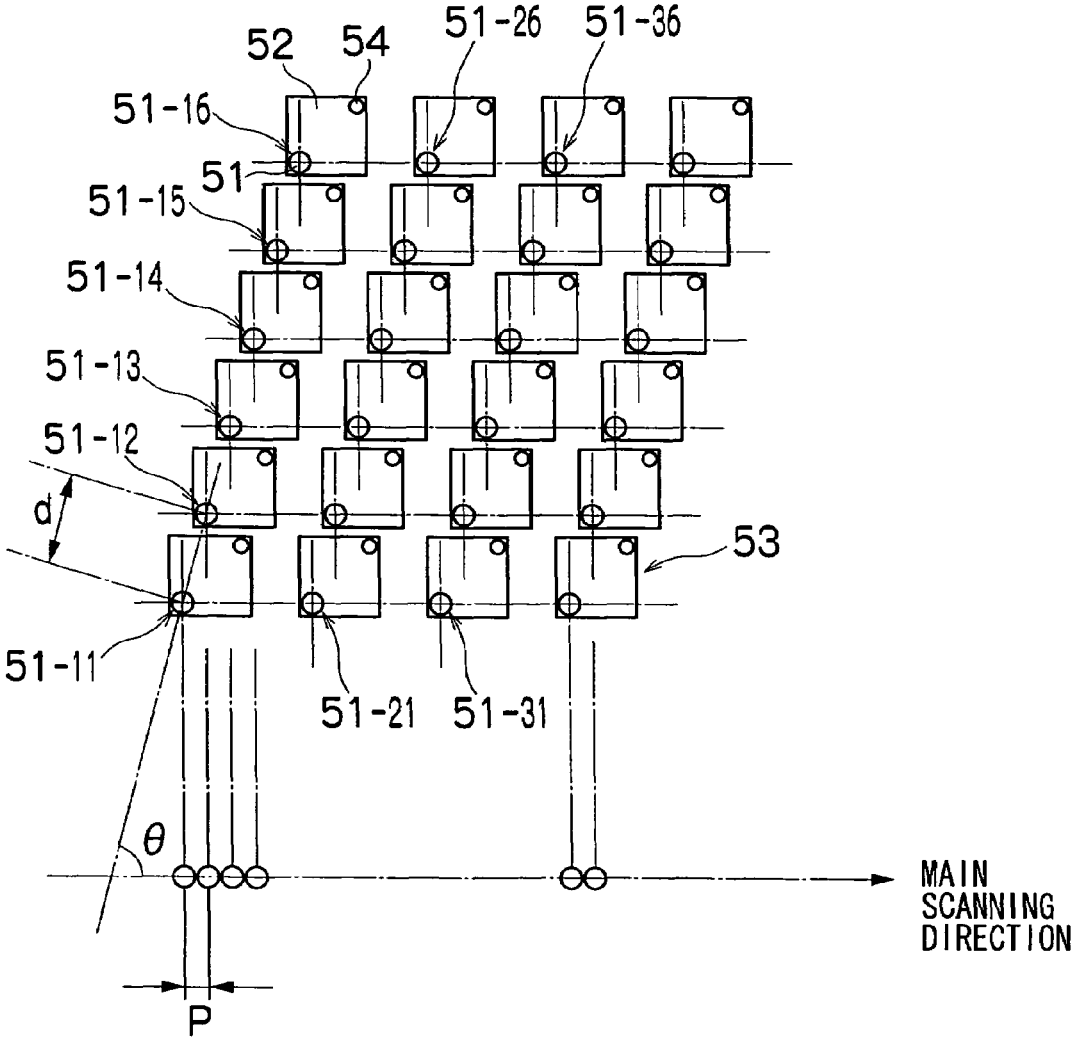
FIG. 5 is an enlarged view showing a nozzle arrangement in the print head illustrated in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, as regards main scanning direction, the nozzles 51 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch. For convenience in description, the structure is described below as one in which the nozzles 51 are arranged at regular intervals (pitch P) in a straight line along the lengthwise direction of the head 50, which is parallel with the main scanning direction.

In the implementation of the present invention, the structure of the nozzle arrangement is not particularly limited to the examples shown in the drawings. Also, in the present embodiment, a method that ejects ink droplets by deforming the actuator 58 represented by a piezoelectric element is adopted. In the implementation of the present invention, an actuator other than a piezoelectric element may also be used as the actuator 58.

Figure 6:
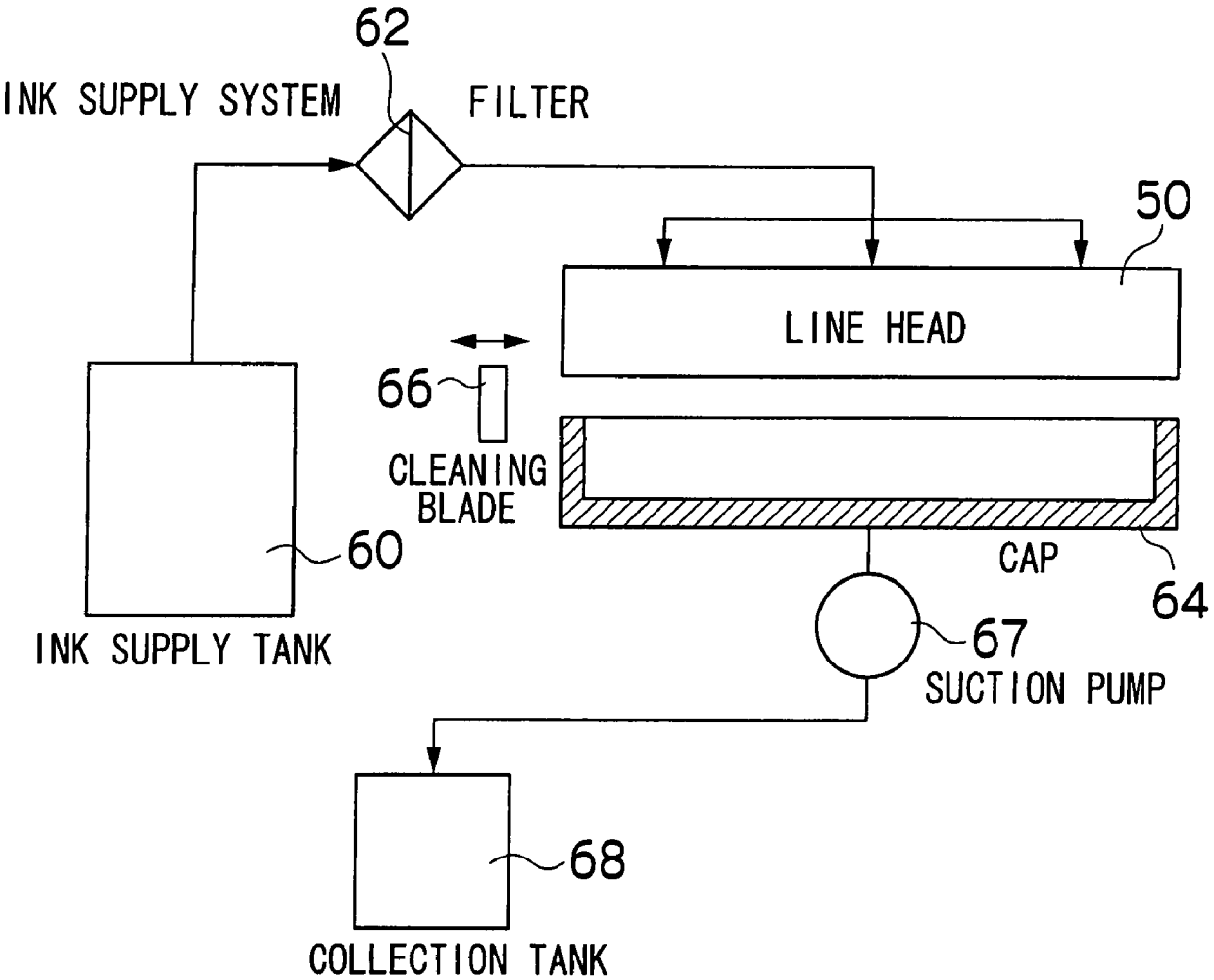
FIG. 6 is an approximate diagram showing the composition of an ink supply unit in an inkjet recording apparatus relating to the present embodiment.

FIG. 6 is a schematic drawing showing the configuration of the ink supply system in the inkjet recording apparatus 10.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The aspects of controlling the internal pressure via the sub tank include an aspect in that internal pressure of the ink chamber unit 53 is controlled via difference of ink surface level of the open air sub tank and the ink chamber unit 53 in the print head 50, an aspect in that internal pressure of the ink chamber and the sub tank are controlled via a pump connected to the closed sub tank, and the like. Each aspect is preferable.

The inkjet recording apparatus 10 is also provided with a cap 64 as a device to prevent the nozzle 51 from drying out or to prevent an increase in the ink viscosity in the vicinity of the nozzles, and a cleaning blade 66 as a device to clean the ink discharge face of the nozzle 51.

A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the ink discharge face of the nozzle 51 is thereby covered with the cap 64.

During printing or standby, when the frequency of use of specific nozzles 51 is reduced and a state in which ink is not discharged continues for a certain amount of time or longer, the ink solvent in the vicinity of the nozzle evaporates and ink viscosity increases. In such a state, ink can no longer be discharged from the nozzle 51 even if the actuator 58 is operated.

Before reaching such a state the actuator 58 is operated (in a viscosity range that allows discharge by the operation of the actuator 58), and a preliminary discharge (purge, air discharge, liquid discharge) is made toward the cap 64 (ink receptor) to which the degraded ink (ink whose viscosity has increased in the vicinity of the nozzle) is to be discharged.

Also, when bubbles have become intermixed in the ink inside the print head 50 (inside the pressure chamber 52), ink can no longer be discharged from the nozzle even if the actuator 58 is operated. The cap 64 is placed on the print head 50 in such a case, ink (ink in which bubbles have become intermixed) inside the pressure chamber 52 is removed by suction with a suction pump 67, and the suction-removed ink is sent to a collection tank 68.

This suction action entails the suctioning of degraded ink whose viscosity has increased (hardened) when initially loaded into the head, or when service has started after a long period of being stopped. The suction action is performed with respect to all the ink in the pressure chamber 52, so the amount of ink consumption is considerable. Therefore, a preferred aspect is one in which a preliminary discharge is performed when the increase in the viscosity of the ink is small.

The cleaning blade 66 is composed of rubber or another elastic member, and can slide on the ink discharge surface (surface of the nozzle plate) of the print head 50 by means of a blade movement mechanism (wiper, not shown). When ink droplets or foreign matter has adhered to the nozzle plate, the surface of the nozzle plate is wiped, and the surface of the nozzle plate is cleaned by sliding the cleaning blade 66 on the nozzle plate. When the unwanted matter on the ink discharge surface is cleaned by the blade mechanism, a preliminary discharge is carried out in order to prevent the foreign matter from becoming mixed inside the nozzles 51 by the blade.

Figure 7:
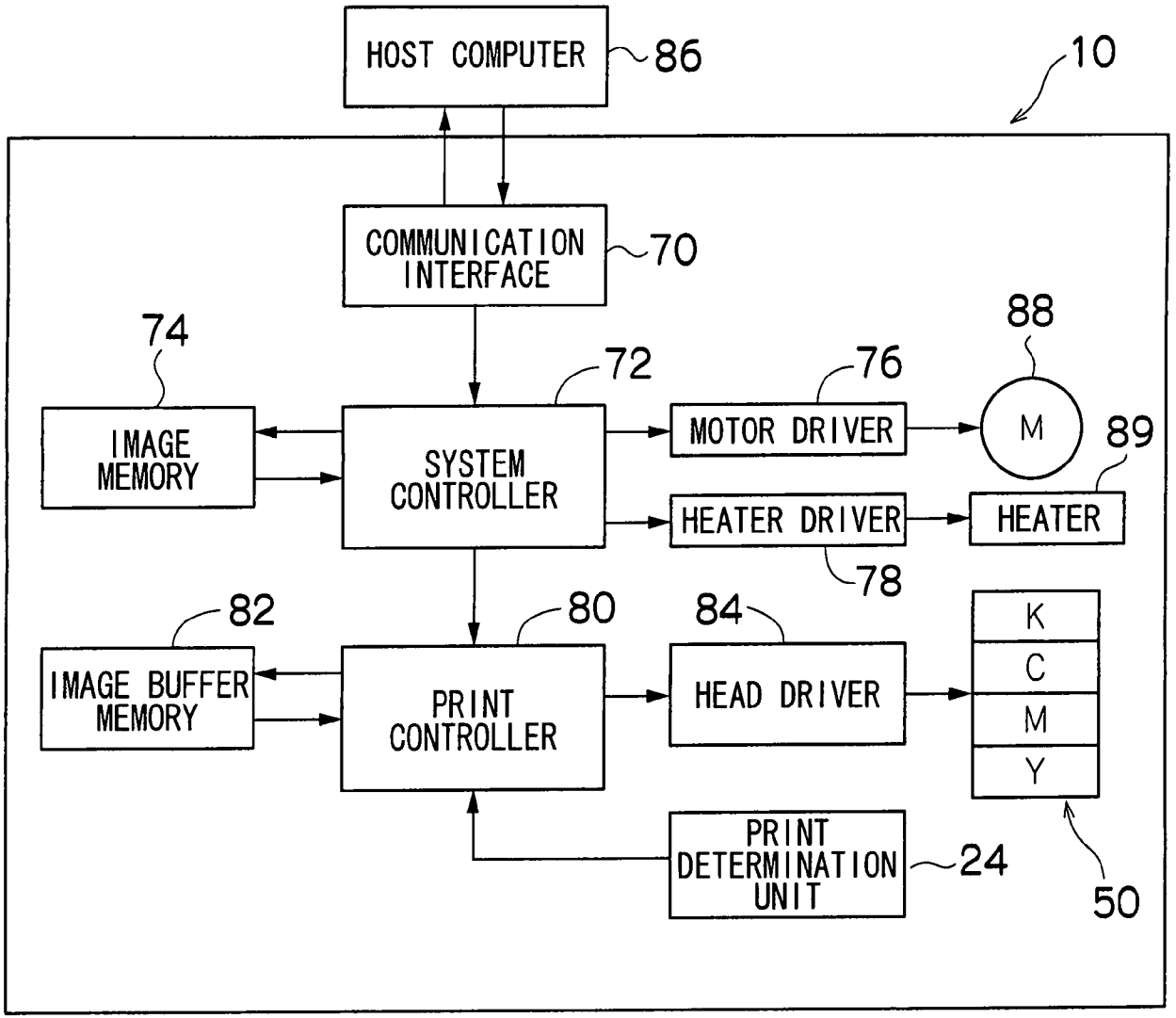
FIG. 7 is a principal part block diagram for illustrating the composition of the system of an inkjet recording apparatus relating to the present embodiment.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver 76 is a driver (drive circuit) which drives the motor 88 in accordance with commands from the system controller 72. Though only the motor driver 76 and the motor 88 are shown in FIG. 7, the system controller 72 controls a plurality of motor drivers and motors.

The heater driver 78 is a driver (drive circuit) which drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

First Embodiment

Next, the recess 59 provided in the vibration plate 56 of the print head 50 according to a first embodiment of the present invention will be described in detail.

Figure 8A:
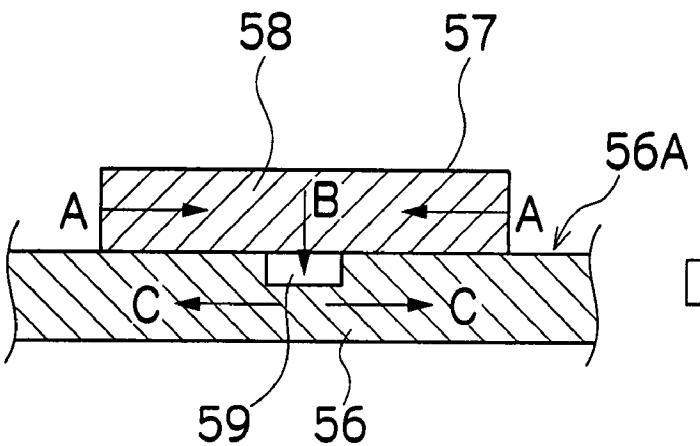
FIG. 8A and FIG. 8B are diagrams illustrating the operational principles of an ink chamber in a print head relating to an embodiment of the present invention.
Figure 8B:
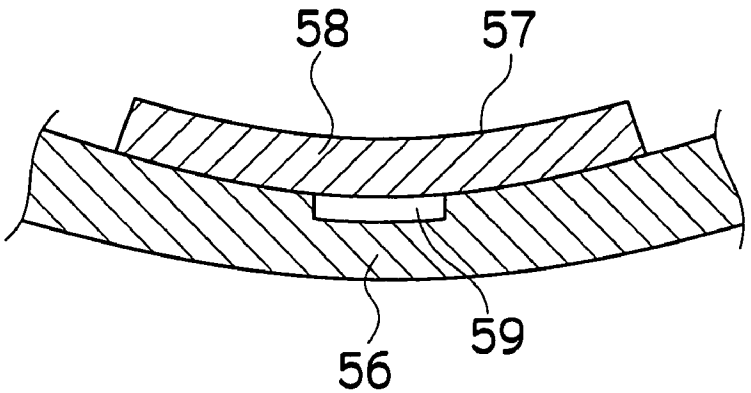

FIG. 8A and FIG. 8B illustrate the effect of the recess 59, which is provided in the active piezoelectric section of the vibration plate 56 on the surface to which the actuator is bonded (hereafter, called the "front surface"). This active piezoelectric section corresponds to the region where the actuator is installed. FIG. 8A and FIG. 8B are cross-sectional diagrams of the ink chamber unit 53 and correspond to FIG. 4. All sections apart from the vibration plate 56, the actuator 58 and the recess 59 have been omitted from the diagram.

In FIG. 8A, when a prescribed voltage is applied to the individual electrode 57, the actuator 58 distorts from the outer edges toward the center region thereof, orthogonally with respect to the direction in which the voltage is applied as shown in FIG. 8A and FIG. 8B. The actuator 58 is a piezoelectric element which utilizes the transverse displacement generated by this distortion (in other words, it is a d31 mode element). A lead zirconium titanate (PZT) material is suitable for the piezoelectric element.

The actuator 58 distorts in the direction indicated by A in FIG. 8A, and the displacement of the actuator 58 is proportional to the voltage applied.

When the actuator 58 distorts, the vibration plate 56 is pressed in the direction indicated by B, and displaced in the direction indicated by C, in other words, from the center towards the outer edges.

FIG. 8B shows a state where the vibration plate 56 and the actuator 58 have been displaced. If the vibration plate 56 is displaced as shown in FIG. 8B, then the volume of the pressure chamber 52 changes and ink corresponding to the amount of change in the volume is discharged from the nozzle 51.

Pressure must be transmitted efficiently from the actuator 58 to the vibration plate 56, in order that the ink in the pressure chamber 52 is discharged satisfactorily. In the vibration plate 56 illustrated in the present example, a recess 59 is provided in at least the front surface of the vibration plate 56 in order to transmit pressure efficiently from the actuator 58 to the vibration plate 56.

By providing a recess 59 in the front surface of the vibration plate in this manner, the region where the recess 59 is disposed becomes less rigid, and hence more liable to be displaced, than the other portions of the plate. Therefore, the displacement of the vibration plate 56 can be increased.

The recess 59 should be provided at least in the region of the surface of the vibration plate where the actuator 58 is installed (in a position corresponding to the actuator). It may be of a length which extends from the region where the actuator 58 is installed, to a position outside this region.

In the present example, a piezoelectric element using displacement in the transverse direction, in other words, a d31 mode piezoelectric element, is described. A d33 mode piezoelectric element would be ineffective in comparison to a d31 mode piezoelectric element, and therefore it is desirable to use a d31 mode element.

FIG. 9A, FIG. 9B, FIG. 9C and FIG. 9D show the shape of the recess 59 in plan view, as observed from the front surface of the vibration plate 56. FIG. 9A, FIG. 9B, FIG. 9C and FIG. 9D show a vibration plate which has a substantially square shape in plan view. If the ink chamber units 53 (nozzles 51) in the print head 50 are disposed at high density, then the ink chamber units 53 must be positioned efficiently. In order to achieve this, desirably, the shape of the ink chamber unit 53, in other words, the shape of the pressure chamber 52, is substantially square, and accordingly, the shape of the actuator 58 (the shape of the individual electrode 57) is also substantially square.

Figure 9A:
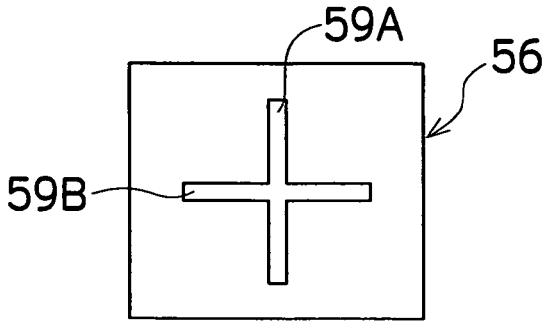
FIG. 9A, FIG. 9B, FIG. 9C and FIG. 9D are diagrams showing the shape of recesses provided in a vibration plate of an ink chamber in a print head relating to a first embodiment of the present invention.

FIG. 9A shows a mode where a recess 59A and a recess 59B are formed on two opposing edges of the edges forming the outer perimeter of the substantially square actuator 58. In FIG. 9A, the recess 59A and the recess 59B intersect in a substantially orthogonal fashion in approximately the center portions thereof, thereby forming a cross shape.

Figure 9B:
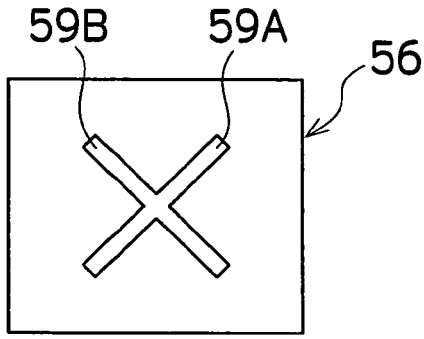

FIG. 9B shows a mode where the recess 59A and the recess 59B forming a cross shape illustrated in FIG. 9A are rotated by approximately 45 degrees. The recess 59A and the recess 59B are formed between opposing vertices, in such a manner that they respectively follow the lines of symmetry of the pressure chamber 52.

FIG. 9A and FIG. 9B show a mode where two recesses 59A and 59B are provided in a substantially orthogonal fashion, but the recess 59 may be formed by three or more recess sections. Furthermore, a plurality of grooves may intersect at angles other than approximately 90°.

For example, three grooves leading from the center toward the outer edges may be provided at intervals of approximately 120°. Alternatively, a recess shape may be obtained by forming a plurality of grooves at two or more angular pitches, such as 45°, 90°, and so on.

Desirably, the shape of the recess 59 in plan view is symmetrical, in such a manner that the displacement of the vibration plate 56 changes continuously from the center toward the outer edge (or from one outer edge toward the opposing outer edge), thus ensuring that there are no regions which are not subject to any displacement at all.

For example, three grooves leading from the center toward the outer edges may be provided at intervals of approximately 120° (namely, a triangular shape), or five grooves leading from the center toward the outer edges may be provided at intervals of approximately 72° (namely, a pentagonal shape). The symmetrical shape adopted may be based on point symmetry, line symmetry or rotational symmetry.

Figure 9C:
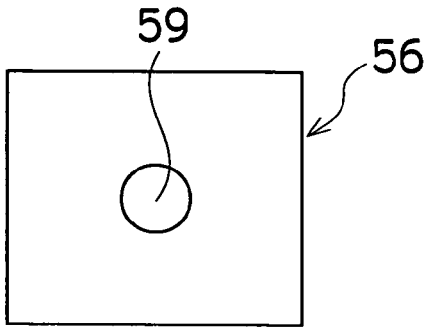
Figure 9D:
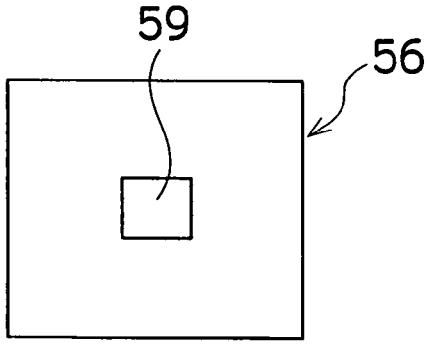

As shown in FIGS. 9C and 9D, the recess 59 does not have to be a groove shape (in other words, one having a long dimension and a short dimension in plan view), and the length and width of the recess 59 may be substantially equal. The shape of the recess in plan view may be a substantially circular shape illustrated in FIG. 9C, or it may be another shape, such as an oval. Of course, it may also be a substantially quadrilateral shape (substantially square shape) as shown in FIG. 9D.

In the present embodiment, the pressure chamber 52 is described as having a substantially square shape, but the pressure chamber 52 may adopt a shape other than a quadrilateral shape. The shape of the pressure chamber 52 is described further here.

In order that the present invention can be applied similarly to pressure chambers of various shapes, and not only to those of quadrilateral shape, the aspect ratio of the shape of the pressure chamber in plan view is defined as follows.

Namely, the ratio between the length in the longitudinal direction and the length of the lateral direction of the pressure chamber in plan view, is defined as the aspect ratio of the pressure chamber. In a regular or substantial polygonal shape, such as a regular or substantial square shape, the aspect ratio is substantially 1. In a substantial circular shape, the aspect ratio is also substantially 1. Desirably, in the present example, the pressure chamber also has an aspect ratio of substantially 1 in plan view. This aspect ratio may also be applied to the shape of the recess in plan view.

The recess 59 may be formed with the same width and depth (thus having a substantially square cross-section), or with different width and depth.

The recess 59 is generally formed in the vibration plate 56 by means of an etching method, such as wet etching or dry etching, which is effective in controlling the position in the width direction, but does not allow easy control in the depth direction. In order to control forming in the depth direction, it is necessary to use anisotropic silicon etching. In this case, silicon is used as the material for the member forming the pressure chamber 52.

Furthermore, the shape of the recess 59 in plan view may be substantially linear, or it may be curved. A shape combining straight lines and curves may also be adopted.

On the other hand, if pressure is to be transmitted efficiently from the actuator 58 to the vibration plate 56, then it must be ensured that the vibration plate 56 and the actuator 58 are bonded together stably. Therefore, escape grooves should be provided in the bonding region of the vibration plate 56 and the actuator 58, in order to prevent accumulation of surplus adhesive and infiltration of air bubbles. When the vibration plate 56 and the actuator 58 are bonded together using adhesive, the recess 59 can be used as an escape groove for surplus adhesive.

In the print head 50 having a vibration plate 56 of the aforementioned composition, a recess 59 is provided on the front surface of the vibration plate 56, in the region where the actuator is installed, at the least. The vibration plate 56 loses rigidity in the region where the recess 59 is provided, and becomes more liable to bend.

Consequently, the displacement of the vibration plate 56 can be increased, and the pressure generated by the actuator 58 can be transmitted efficiently to the ink inside the pressure chamber 52, since the vibration plate 56 forms the ceiling of the pressure chamber 52. Desirably, the shape of the grooves 59 is symmetrical, in order that the vibration plate 56 can be displaced easily.

Furthermore, if the recess 59 is used as an escape groove for the adhesive employed in bonding the vibration plate 56 with the actuator 58, then stable bonding of the vibration plate 56 and the actuator 58 can be ensured.

Second Embodiment

Next, a print head according to a second embodiment of the present invention is described with reference to FIG. 10A to FIG. 12B. In FIG. 10A to FIG. 12B, items which are the same as or similar to those in FIG. 4, FIG. 8A, FIG. 8B, FIG. 9A, FIG. 9B, FIG. 9C, and FIG. 9D are labeled with the same reference numerals and description thereof is omitted here.

This embodiment describes a recess provided in a vibration plate with the principal object of reducing cross-talk, namely, the phenomenon where a vibration plate is distorted and displaced unintentionally due to the effects of the displacement (distortion) of another vibration plate in an adjacent ink chamber.

Figure 10A:
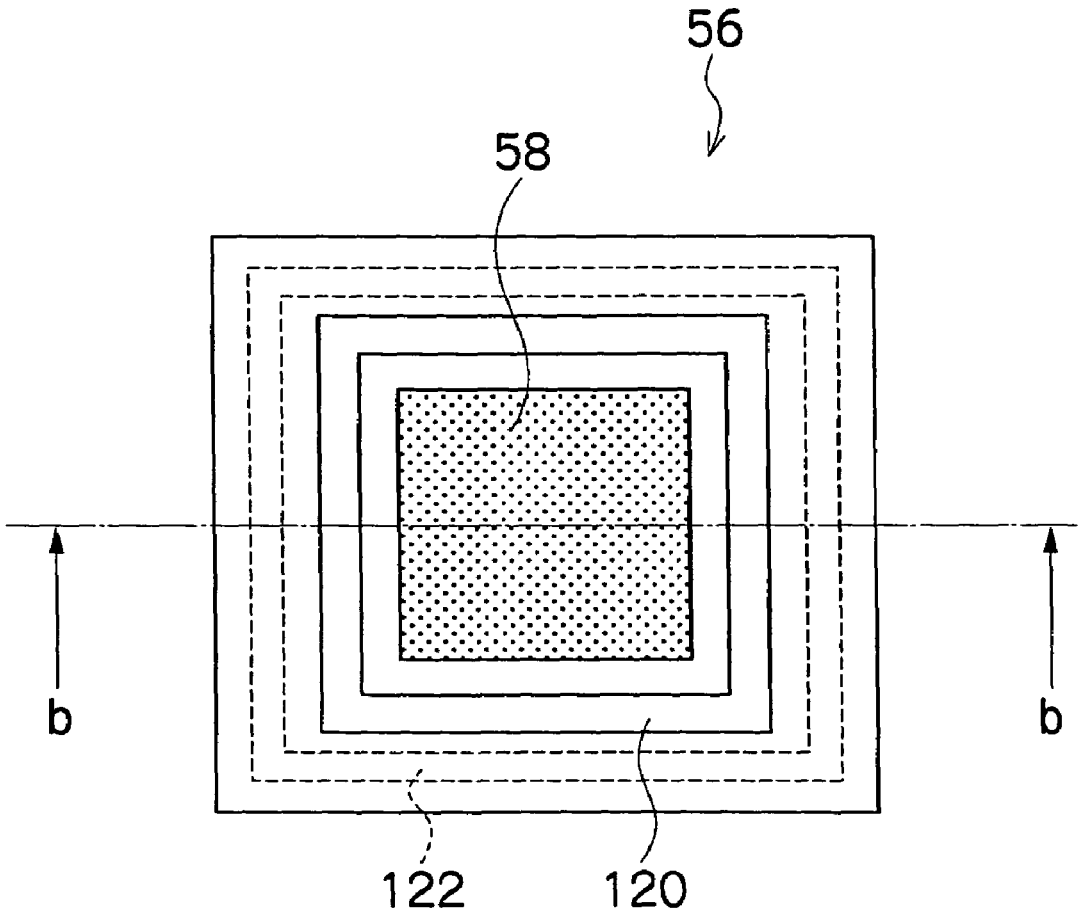
FIG. 10A and FIG. 10B are diagrams showing the shape of recesses provided in a vibration plate of an ink chamber in a print head relating to a second embodiment of the present invention.
Figure 10B:
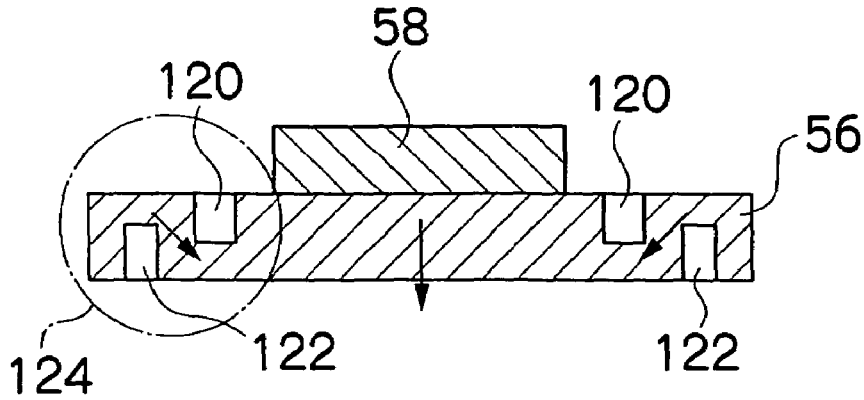

FIG. 10A is a plan diagram showing a vibration plate 56 as viewed from the front surface thereof, and FIG. 10B is a cross-sectional diagram along line b-b in FIG. 10A.

A recess 120 is formed outside the active piezoelectric section on the front surface of the vibration plate 56, and a recess 122 is also formed outside the active piezoelectric section on the side of the vibration plate 56 adjacent to the pressure chamber (hereafter, called the "rear surface"). The recesses 120 and 122 are formed in line with the four edges which constitute the outer perimeter of the vibration plate 56, in such a manner that they surround the active piezoelectric section.

Here, the "active piezoelectric section" indicates the region where displacement is produced inside the vibration plate 56, when pressure is applied to the vibration plate 56 by the actuator 58. In other words, the region outside the active piezoelectric section indicates the region of the vibration plate 56 which does not perform the displacement indicative of the active piezoelectric section.

As shown in FIG. 10B, the recess 120 and the recess 122 are offset in different positions when observed in plan view. FIG. 1A shows an enlarged view of the recess 120 and the recess 122 (namely, an enlargement of the region indicated by numeral 124 in FIG. 10B).

If recesses are formed by etching on both surfaces, then the depth of the recesses is generally half or more than half the thickness of the vibration plate 56 as shown in FIG. 1A. Therefore, when forming grooves on both surfaces of the vibration plate 56, the positions of the grooves in plan view are offset in order to obtain a stable structure.

Figure 11A:
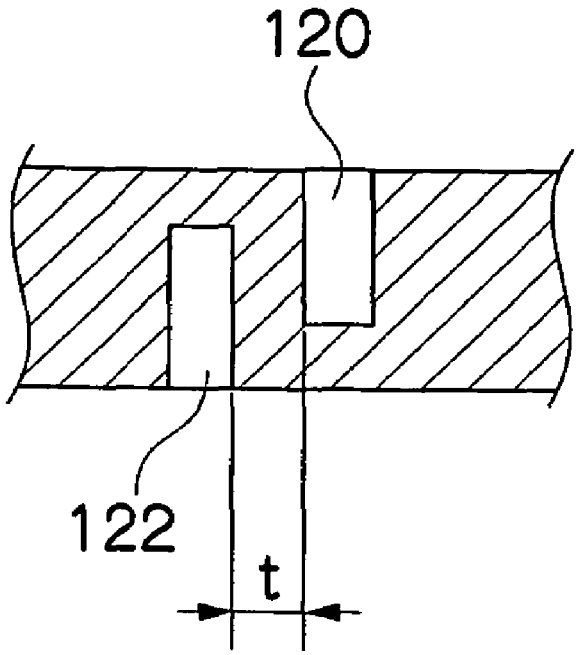
FIG. 11A and FIG. 11B are partial enlarged views of FIG. 10A and FIG. 10B.
Figure 11B:
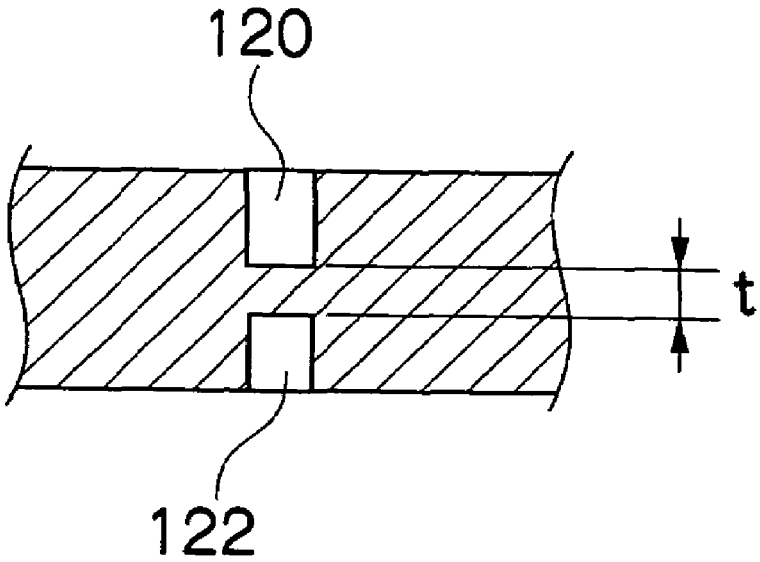

Of course, if another method of manufacture is used, then the recess 120 and the recess 122 may be situated in the same position in plan view, as illustrated in FIG. 11B. Provided that the interval between the recesses 120 and 122, as indicated by the symbol "t" in FIGS. 11A and 11B, is substantially the same, then practically the same effect in reducing cross-talk will be obtained in either of the cases described above.

Figure 12A:
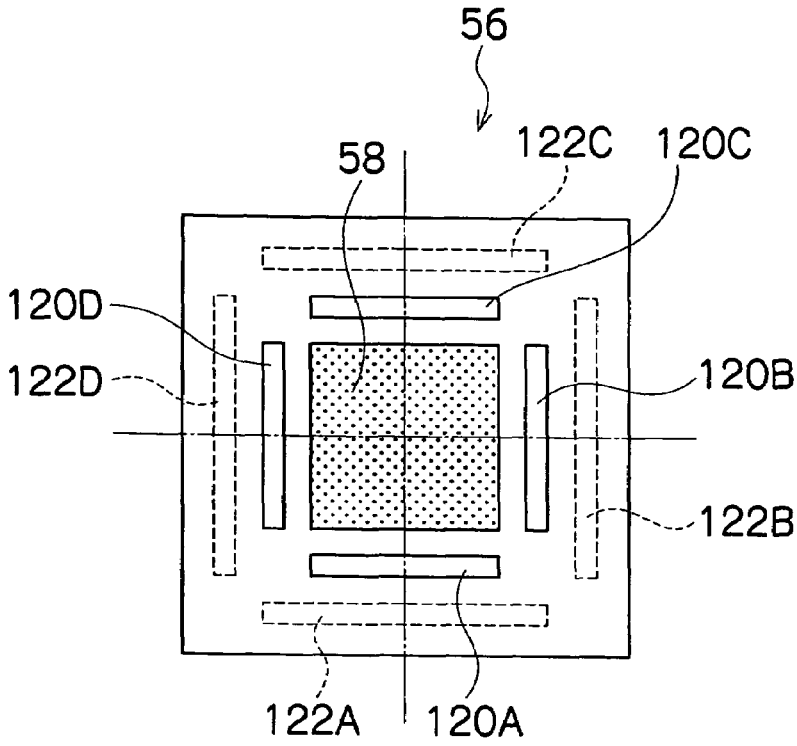
FIG. 12A and FIG. 12B are diagrams showing further modes of the recesses provided in the vibration plate illustrated in FIG. 10A and FIG. 10B.
Figure 12B:
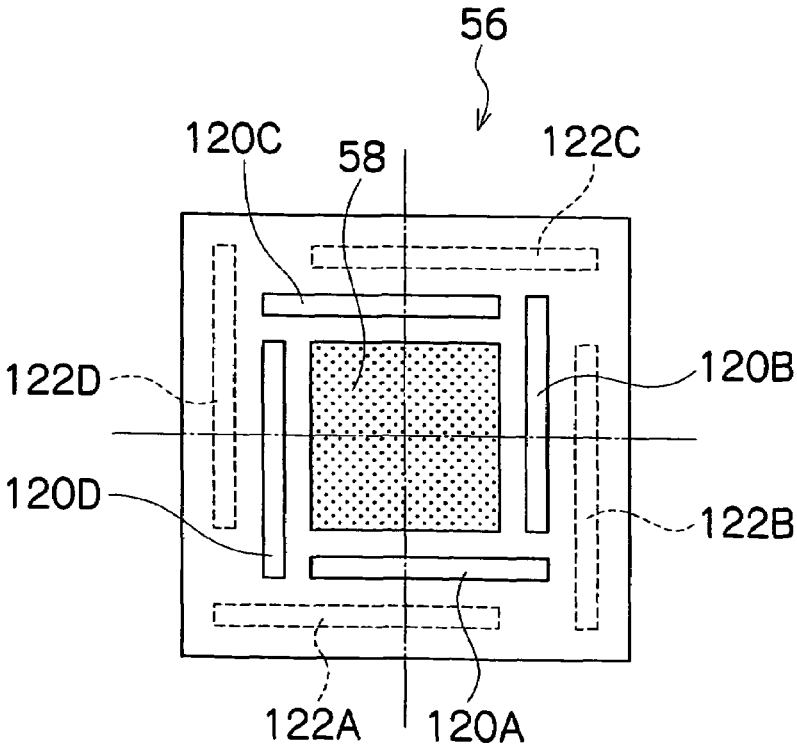

FIGS. 12A and 12B show further modes of the recess 120 and the recess 122. As shown in FIGS. 12A and B, the recess 120 and the recess 122 are may be respectively constituted by four grooves (the recesses 120A, 120B, 120C and 120D, and the recesses 122A, 122B, 122C and 122D).

In FIG. 12A, the center lines of the respective recess sections coincide substantially with the center lines of the actuator 58 (namely, the centers of the edges forming the outer perimeter of the actuator 58). Each recess section 120 is substantially the same length as one edge of the actuator 58.

In FIG. 12B, the center lines of the respective recess sections do not coincide with the center lines of the actuator 58. Furthermore, at least one end of each recess section is aligned with an end of the actuator 58.

Of course, other modes besides these can also be envisaged. For example, an L-shaped recess comprising mutually connected recess sections 120A and 120B, and an L-shaped recess comprising mutually connected recess sections 120C and 120D, may also be formed. Furthermore, a U-shaped recess comprising mutually connected recess sections 120A, 120B and 120C, and a recess section 120D, may also be formed.

In a print head 50 having the vibration plate 56 of the aforementioned composition, a recess 120 is provided on the front surface of the vibration plate, and recess 122 is provided on the rear surface of same, outside the active piezoelectric section. Therefore cross-talk between adjacent ink units can be reduced.

The present embodiment related to an example where a recess 120 is provided on the front surface of the vibration plate 56 and a recess 122 is provided on the rear surface of the vibration plate 56, but it is also possible to provide a recess on either the front surface or the rear surface of the vibration plate 56, only.

Various shapes may be adopted for the recess 120 and the recess 122. It is especially desirable if the shape is a symmetrical shape, based on point symmetry, rotational symmetry taking the approximate center of the vibration plate 56 as the center of rotation, or line symmetry taking the center lines shown in FIG. 12A as axes of symmetry.

Third Embodiment

Next, a print head 50 according to a third embodiment of the present invention is described with reference to FIG. 13A to FIG. 18D.

The third embodiment relates to a mode which combines the recess 59 described in the first embodiment, which contributes principally to increasing the displacement of the vibration plate 56, with the recess 120 (and recess 122) described in the second embodiment, which contributes principally to reducing cross-talk.

Figure 13A:
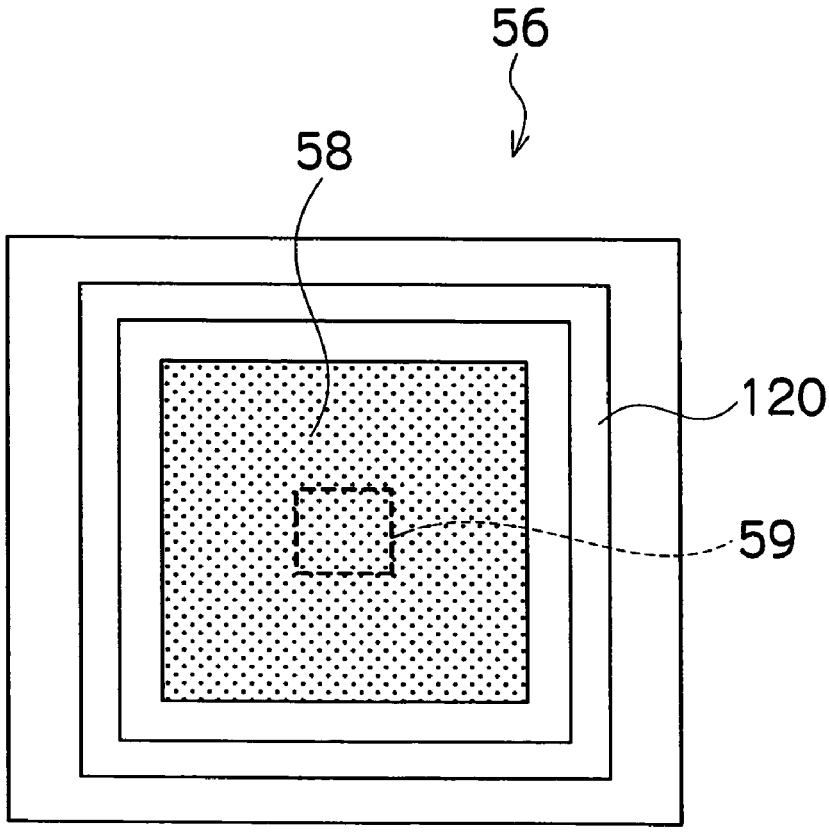
FIG. 13A and FIG. 13B are diagrams showing the shape of recesses provided in a vibration plate of an ink chamber in a print head relating to a third embodiment of the present invention.
Figure 13B:
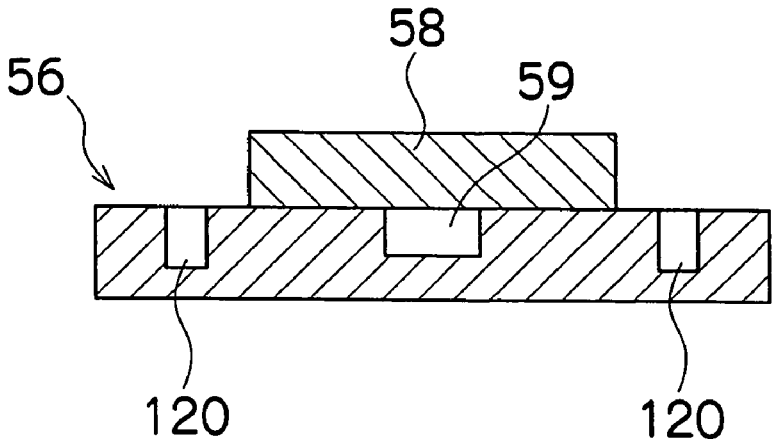

FIGS. 13A and 13B show a case where a recess 59 as illustrated in FIG. 9D is provided on the front surface of the vibration plate 56, in a position corresponding to the actuator 58, and a recess 120 as illustrated in FIG. 10A and FIG. 10B is also provided on the front surface of the vibration plate 56, in a position outside the active piezoelectric section. FIG. 13A is a plan diagram showing the vibration plate 56 as viewed from the front surface and FIG. 13B is a cross-sectional diagram (corresponding to FIG. 10B).

Figure 14:
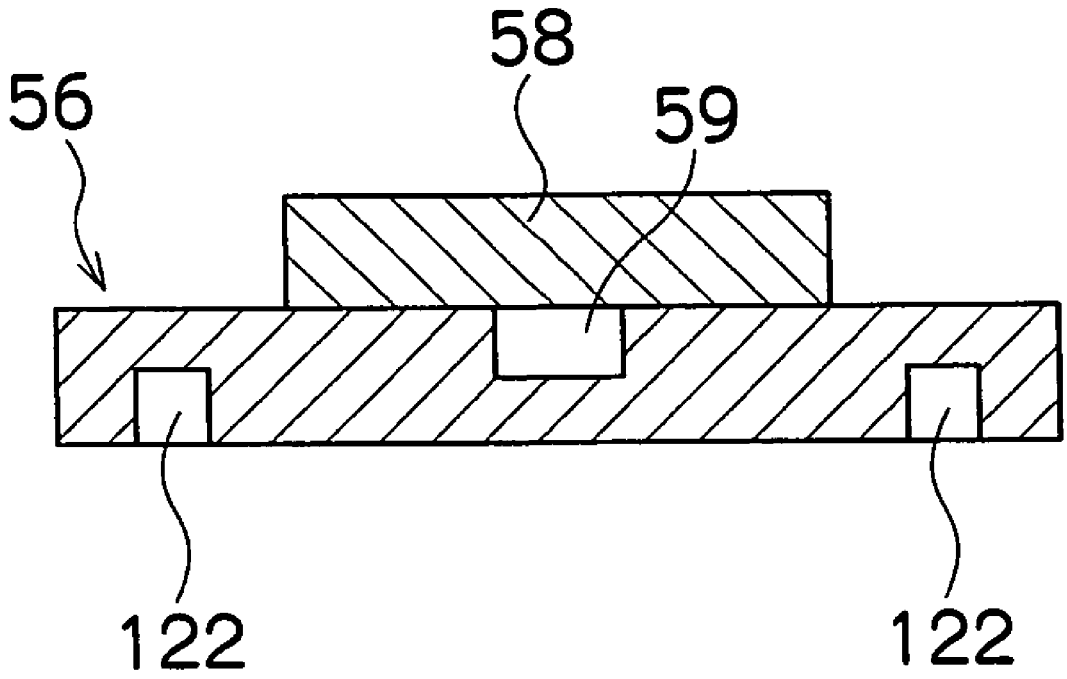
FIG. 14 is a diagram showing a modification of the mode illustrated in FIG. 13A and FIG. 13B.
Figure 15A:
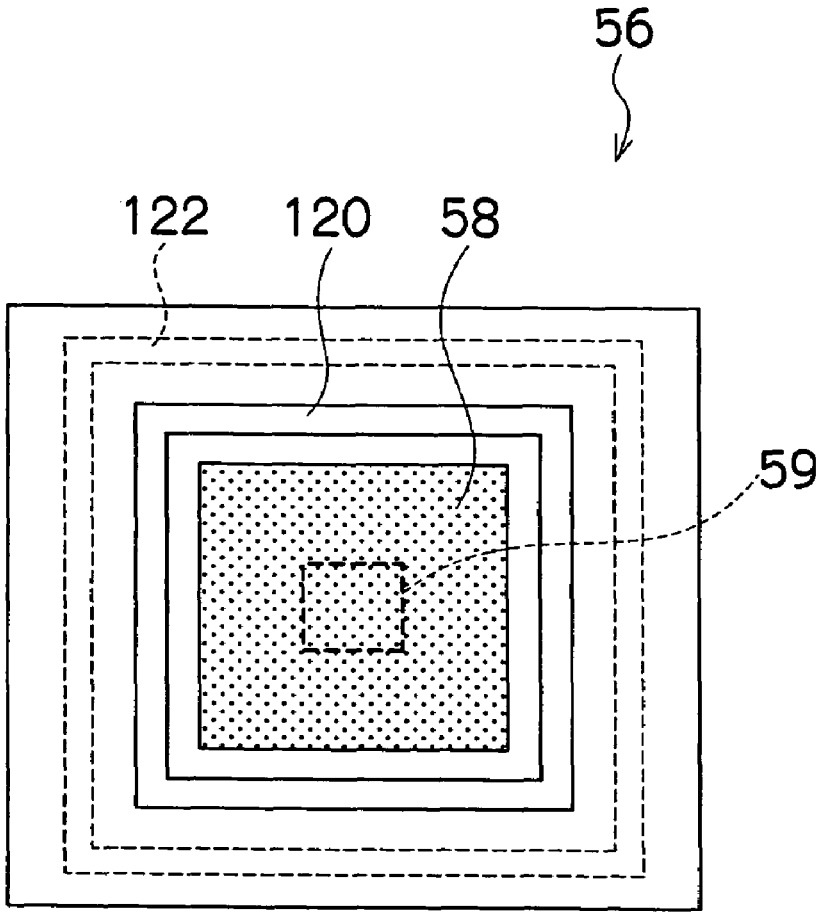
FIG. 15A and FIG. 15B are diagrams showing a practical example of the mode illustrated in FIG. 13A and FIG. 13B.
Figure 15B:
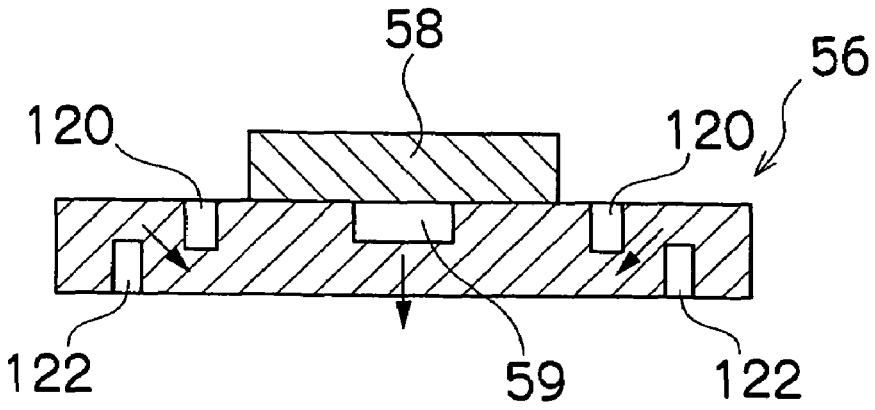
Figure 16A:
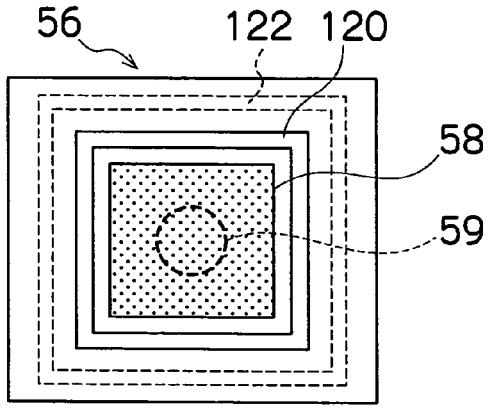
FIG. 16A, FIG. 16B, FIG. 16C and FIG. 16D are diagrams showing further modes of the recesses provided in the vibration plate illustrated in FIG. 13A and FIG. 13B.
Figure 16B:
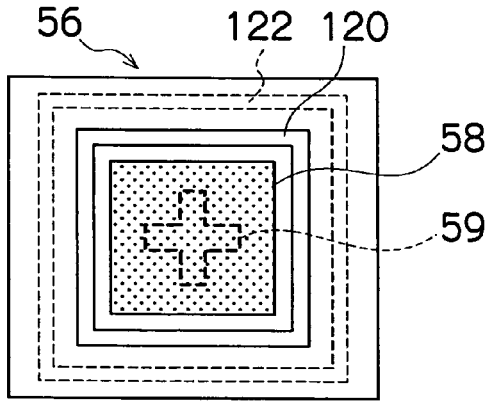
Figure 16C:
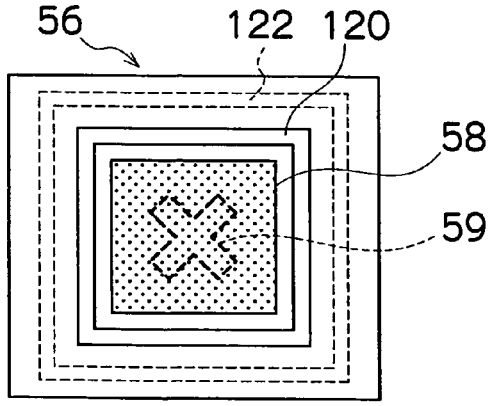
Figure 16D:
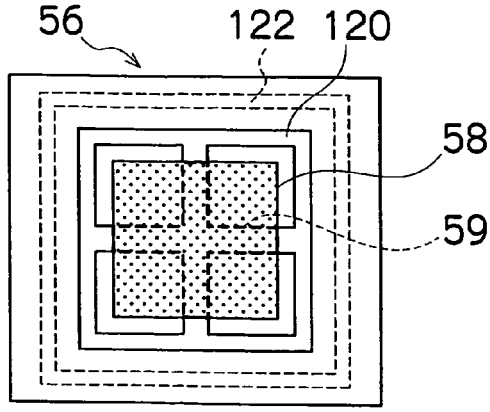

As shown in FIG. 14, it is also possible to provide a recess 122 as illustrated in FIG. 10B, outside the active piezoelectric section on the rear surface of the vibration plate, instead of the recess 120 provided on the front surface of the vibration plate 56. As shown in FIG. 15A and FIG. 15B, it is also possible to provide a recess 120 outside the active piezoelectric section on the front surface of the vibration plate, as well as providing a recess 122 outside the active piezoelectric section on the rear surface of the vibration plate 56.

FIGS. 16A, 16B, 16C and 16D show respective shapes of a recess 59 provided in a position corresponding to the actuator 58 on the front surface of the vibration plate 56. As illustrated in FIGS. 16A to 16D, the recess 59 may have a circular shape, a cross shape, or a rotated cross shape, and the recess 59 and the recess 120 may be connected. Of course, shapes other than these may also be adopted.

Figure 17A:
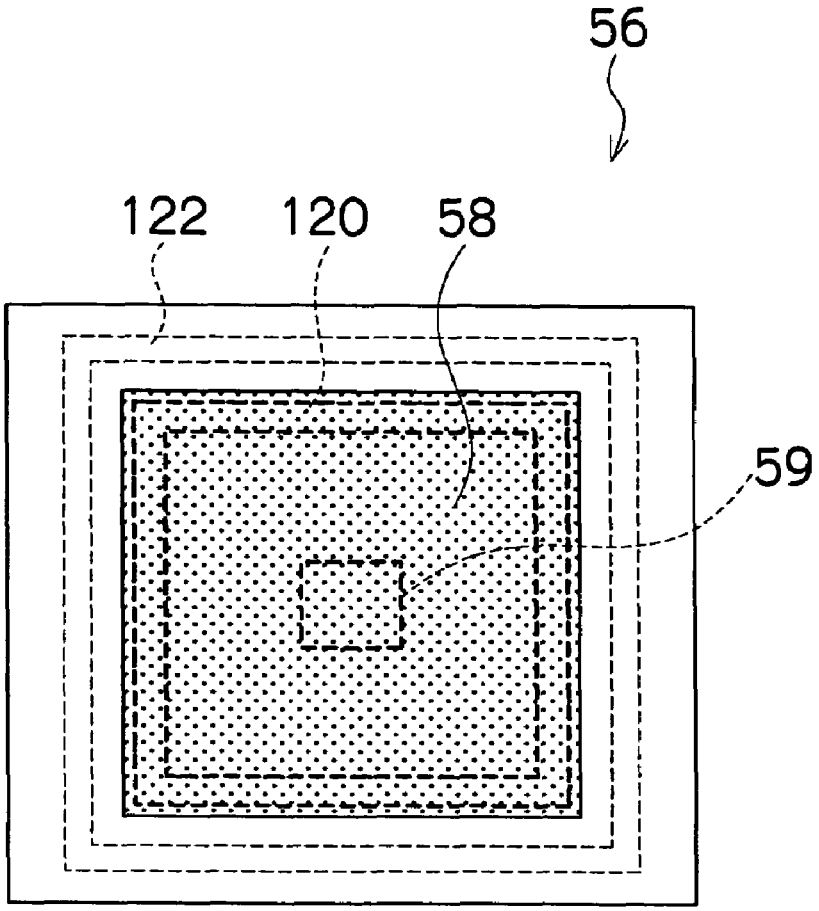
FIG. 17A and FIG. 17B are diagrams showing modifications of the mode illustrated in FIG. 15A and FIG. 15B.
Figure 17B:
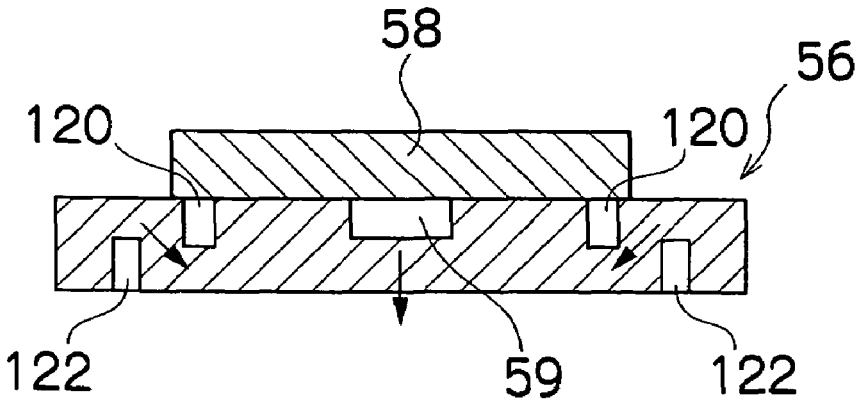
Figure 18A:
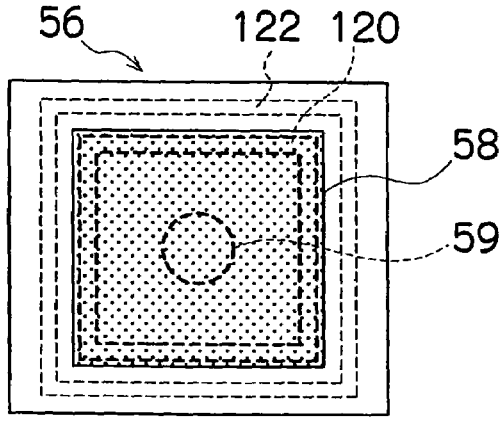
FIG. 18A, FIG. 18B, FIG. 18C and FIG. 18D are diagrams showing further modes of the recesses provided in the vibration plate illustrated in FIG. 17A and FIG. 17B.
Figure 18B:
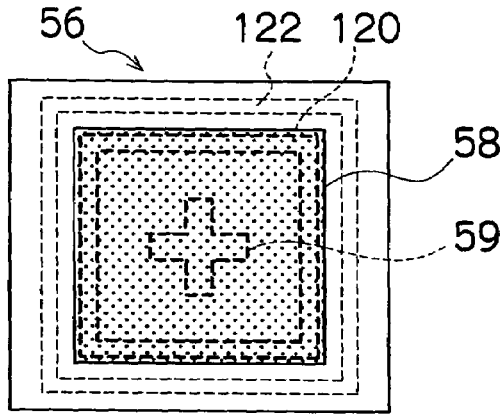
Figure 18C:
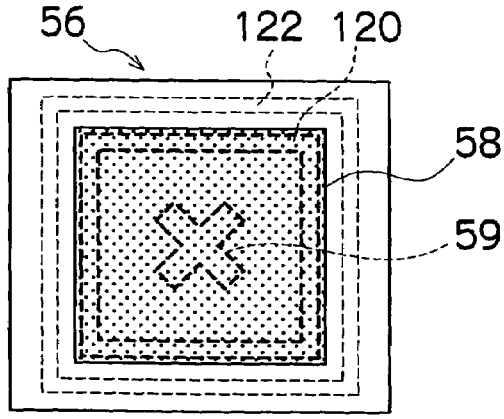
Figure 18D:
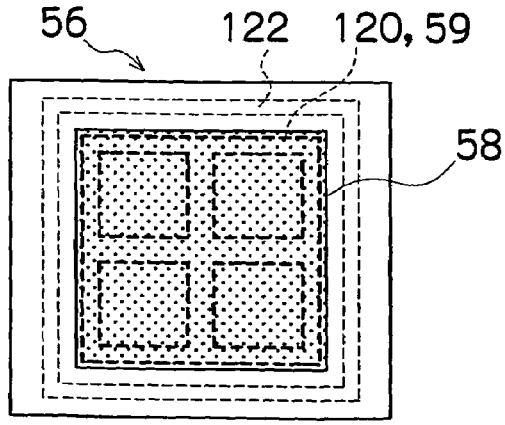

FIGS. 17A and 17B show a mode where the recess 120 illustrated in FIG. 16A, FIG. 16B, FIG. 16C, and FIG. 16D is provided in a position corresponding to the actuator 58.

In the mode illustrated in FIGS. 17A and 17B, the recess 120 functions principally as an escape groove for adhesive. In other words, in this mode, a recess 59 contributing principally to increase in the displacement of the vibration plate 56, and a recess 120 functioning principally as an escape groove for adhesive, are provided on the front surface of the vibration plate 56. The recess 59 also serves as an escape groove for adhesive, and the recess 120 also serves to increase the displacement of the vibration plate.

FIGS. 18A, 18B, 18C and 18D show respective shapes of the recess 59 in the mode illustrated in FIGS. 17A and 17B. As illustrated in FIGS. 18A to D, the recess 59 may have a circular shape, a cross shape, or a rotated cross shape, and the recess 59 and the recess 120 may be connected. Of course, shapes other than these may also be adopted.

As described above, by suitably combining a recess 59 provided in a position corresponding to the actuator 58 on the front surface of the vibration plate 56, a recess 120 provided outside the active piezoelectric section on the front surface of the vibration plate 56, and a recess 122 provided outside the active piezoelectric section on the rear surface of the vibration plate 56, it is possible to increase the amount of displacement of the vibration plate 56, reduce cross-talk, and ensure stable bonding between the vibration plate 56 and thy actuator 58. Furthermore, the recess 120 provided on the front surface of the vibration plate 56 contributes principally to increasing the displacement of the vibration plate 56 and ensuring stable bonding, if it is situated in the active piezoelectric section, and it contributes principally to reducing cross-talk, if it is situated outside the active piezoelectric section.

The embodiments described above related to examples where one actuator (piezoelectric element) is provided on the vibration plate 56, but the present invention may also be applied to split electrode type piezoelectric element, wherein a plurality of individual electrodes are provided on one piezoelectric plate, and each region where an individual electrode is installed is caused to function as a single piezoelectric element.

The embodiments described above related to a print head 50 of an inkjet recording apparatus 10, but the application of the present invention is not limited to inkjet recording apparatuses, and the present invention may also be applied to a droplet discharging apparatus for discharging water, a liquid chemical, a processing liquid, or the like, from discharge holes (nozzles) provided in a head.

What is claimed is:

1. A discharging head for discharging liquid onto a discharge receiving medium, comprising:

a vibration plate forming at least a portion of a pressure chamber storing liquid to be discharged; and a piezoelectric element, joined to said vibration plate, for generating a pressure forming a discharge force for discharging liquid inside said pressure chamber, wherein a first recess formed as grooves that intersect on a surface of the vibration plate that joins to said piezoelectric element in an approximately central region of said vibration plate, the intersecting portions of the grooves forming the first recess substantially occupying a central part of the central region where said piezoelectric element is joined to said vibration plate, and a second recess is provided on a surface of said vibration plate that is adjacent to said pressure chamber and in a position where an entirety of said second recess is outside the region of said vibration plate where said piezoelectric element is joined to said vibration plate, wherein a depth to width ratio of the second recess exceeds 1.

2. The discharging head according to claim 1, wherein a shape of said pressure chamber in plan view is a shape whereby a ratio between a length in a longitudinal direction of the plan view and the length in a lateral direction of the plan view is approximately 1.

3. The discharging head according to claim 1, wherein said piezoelectric element is a piezoelectric element operating in d31 mode.

4. The discharging head according to claim 1, wherein said pressure chambers having said vibration plate are arranged two-dimensionally.

5. A liquid discharging apparatus comprising the discharging head according to claim 1.

6. The discharging head according to claim 1, wherein the shape of said recess in plan view is a shape having rotational symmetry.

7. The discharging head according to claim 1, further comprising:

a third recess provided on the surface of said vibration plate where said piezoelectric element is joined to said vibration plate in a position where an entirety of said third recess is outside the region of said vibration plate where said piezoelectric element is joined to said vibration plate.

8. The discharging head according to claim 7, wherein a shape of said pressure chamber in plan view is a shape whereby a ratio between a length in a longitudinal direction of the plan view and the length in a lateral direction of the plan view is approximately 1.

9. The discharging head according to claim 7, wherein said piezoelectric element is a piezoelectric element operating in d31 mode.

10. The discharging head according to claim 7, wherein said pressure chambers having said vibration plate are arranged two-dimensionally.

11. A liquid discharging apparatus comprising the discharging head according to claim 7.

12. The discharging head according to claim 7, wherein the shape of said recess in plan view is a shape having rotational symmetry.

13. The discharging head according to claim 7, wherein a depth of the second recess and a depth of the third recess are more than half a thickness of the vibration plate.

14. A discharging head for discharging liquid onto a discharge receiving medium, comprising:

a vibration plate forming at least a portion of a pressure chamber holding liquid to be discharged; and a piezoelectric element, joined to said vibration plate, for generating a pressure forming a discharge force for discharging liquid inside said pressure chamber, wherein a first recess formed as grooves that intersect on a surface of the vibration plate where said piezoelectric element is joined to said vibration plate in an approximately central region of said vibration plate, the intersecting portions of the grooves forming the first recess substantially occupying a central part of the central region where said piezoelectric element is joined to said vibration plate, a second recess is provided on the surface of said vibration plate adjacent to said pressure chamber and in a position where an entirety of said second recess is outside the region of said vibration plate where said piezoelectric element is joined to said vibration plate, and a third recess is provided on the surface of said vibration plate where the piezoelectric element is joined to said vibration plate, in the region of the vibration plate where said piezoelectric element is joined to said vibration plate, wherein a depth of both the second recess and the third recess is more than half a thickness of the vibration plate.

15. The discharging head according to claim 14, wherein the shape of said recess in plan view is a shape having rotational symmetry.

16. A discharging head for discharging liquid onto a discharge receiving medium, comprising:

a vibration plate forming at least a portion of a pressure chamber storing liquid to be discharged; and a piezoelectric element, joined to said vibration plate, for generating a pressure forming a discharge force for discharging liquid inside said pressure chamber, wherein a recess is formed in the approximate center of the region of said vibration plate where said piezoelectric element is joined to said vibration plate, the shape of said recess in plan view is a shape having rotational symmetry that is identical when rotated by n degrees (where $n<180°$), and the recess occupies the substantially central part of the region of said vibration pate where said piezoelectric element is joined to said vibration plate, wherein the recess includes grooves which intersect with each other at the substantially central part of the region of said vibration plate where said piezoelectric element is joined to said vibration plate.

17. The discharging head according to claim 16, wherein the recess is provided on a surface of said vibration plate where said piezoelectric element is joined to said vibration plate.

* * * * *